US007090144B2

(12) United States Patent
Gross et al.

(10) Patent No.: US 7,090,144 B2
(45) Date of Patent: Aug. 15, 2006

(54) WATER FOUNTAIN ATTACHMENT FOR A FAUCET

(76) Inventors: Lloyd A. Gross, 116 Lemonton Way, Radnor, PA (US) 19087; Gordon L. Gross, 906 Artis Rd., Plymouth Meeting, PA (US) 19462; Andrew N. Gross, 547 Olivia Way, Lafayette Hill, PA (US) 19444

( * ) Notice: Subject to any disclaimer, the term of this patent is extended or adjusted under 35 U.S.C. 154(b) by 0 days.

(21) Appl. No.: 10/696,904

(22) Filed: Oct. 30, 2003

(65) Prior Publication Data

US 2005/0098650 A1 May 12, 2005

(51) Int. Cl.
*B05B 12/14* (2006.01)
*B05B 1/30* (2006.01)

(52) U.S. Cl. ..... 239/26; 239/25; 239/579; 239/581.1; 239/447; 137/625.48; 137/464

(58) Field of Classification Search ..... 239/24–26, 239/29, 32, 569, 575, 581.1, 581.2, 582.1, 239/DIG. 23, 435, 462, 447; 251/345, 343, 251/252

See application file for complete search history.

(56) References Cited

U.S. PATENT DOCUMENTS

| | | | | |
|---|---|---|---|---|
| 1,069,910 | A | 8/1913 | Taylor | |
| 1,105,547 | A | 7/1914 | Coffield | |
| 1,149,586 | A | 8/1915 | Piper | |
| 2,245,041 | A | 6/1941 | McCurdy | |
| 2,988,288 | A | 6/1961 | Nielsen | 239/431 |
| 2,994,481 | A | 8/1961 | Blumberg | |
| 3,101,174 | A | 8/1963 | Loveland | 239/27 |
| 3,133,701 | A * | 5/1964 | McClenahan | 239/25 |
| 3,325,101 | A | 6/1967 | Cusehera | |
| 3,335,957 | A | 8/1967 | Jacobson | |
| 3,443,753 | A | 5/1969 | McDonnell | 239/27 |
| 3,552,651 | A | 1/1971 | Garrison | |
| 4,072,270 | A | 2/1978 | Harmony | |
| 4,448,351 | A | 5/1984 | Aldinger et al. | |
| 4,537,350 | A | 8/1985 | Apri | |
| 4,552,306 | A | 11/1985 | Litwak et al. | |
| 4,609,006 | A | 9/1986 | Parkison et al. | 137/119 |
| 4,778,108 | A * | 10/1988 | Richards | 239/26 |
| 4,934,597 | A | 6/1990 | Crutcher | 239/27 |
| 4,991,775 | A * | 2/1991 | Huber et al. | 239/25 |
| 5,025,825 | A | 6/1991 | Gayton | 137/119 |
| 5,054,514 | A * | 10/1991 | Valdes Marin | 251/321 |
| 5,069,241 | A * | 12/1991 | Hochstrasser | 137/119.05 |
| 5,072,757 | A * | 12/1991 | Lin | 137/615 |
| 5,148,832 | A * | 9/1992 | Lin | 137/615 |
| 5,257,647 | A * | 11/1993 | Wilhite | 239/25 |
| 5,806,771 | A | 9/1998 | Loschelder et al. | 239/446 |
| 6,367,707 | B1 * | 4/2002 | Kang | 239/26 |

* cited by examiner

*Primary Examiner*—David A. Scherbel
*Assistant Examiner*—Seth Barney
(74) *Attorney, Agent, or Firm*—Synnestvedt & Lechner LLP

(57) ABSTRACT

A water fountain diverter device connectable to a faucet for selectively directing water from a normal downward direction, to an upward direction for direct drinking by a user. The device has a body connectable to the faucet, a body inlet for receiving water from the faucet, an outlet through which water can flow un-diverted, and a spout from which a water stream flows for direct drinking when the water is diverted via a valve within the device.

22 Claims, 7 Drawing Sheets

FIG.4
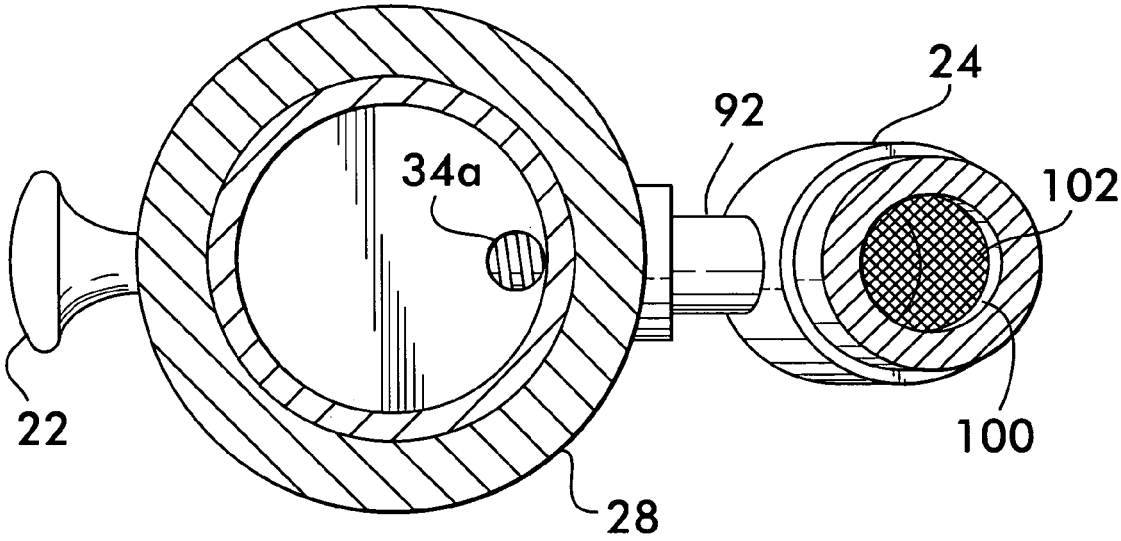
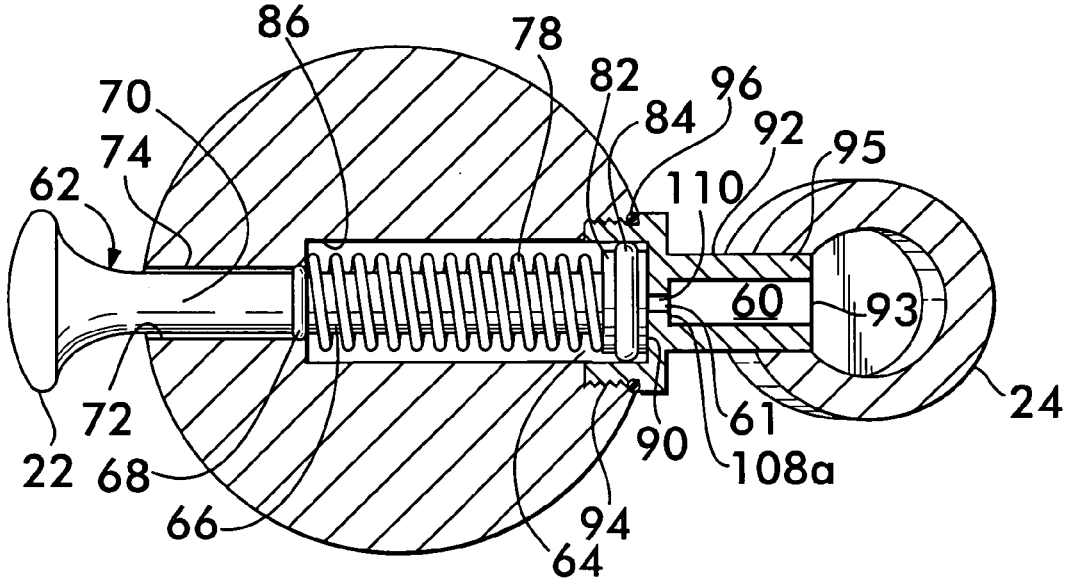
FIG.5

FIG. 6
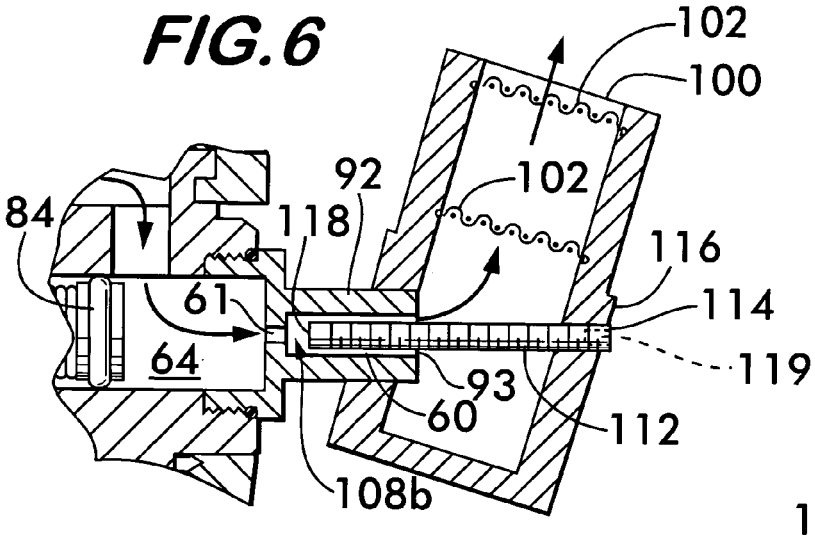
FIG. 7
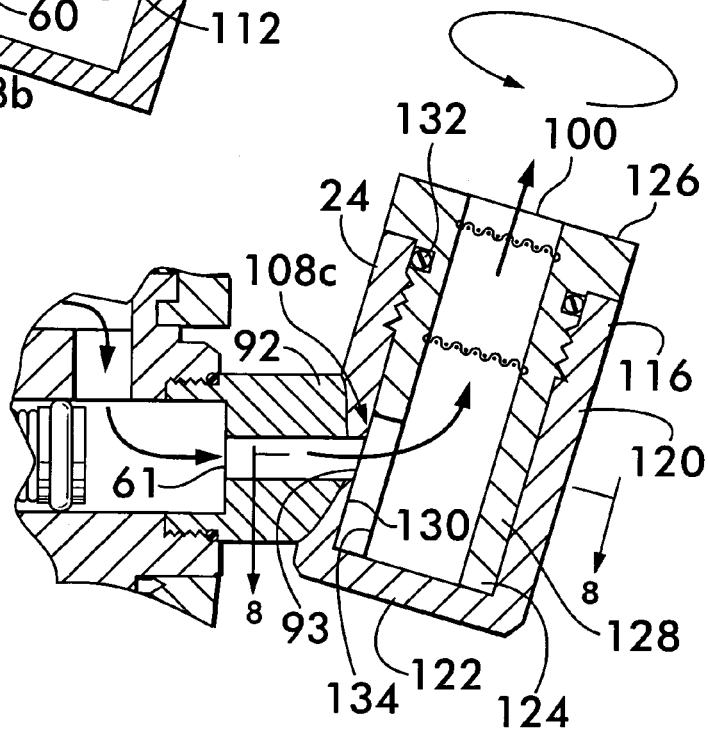
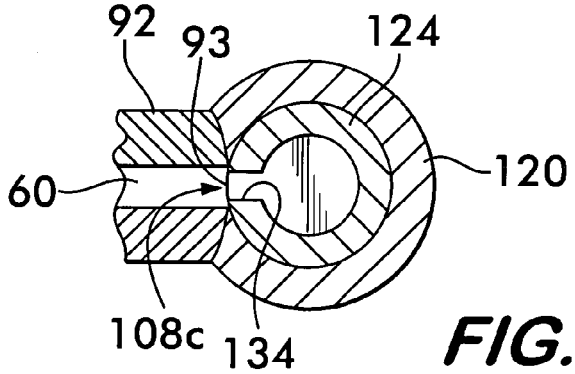
FIG. 8

FIG.10
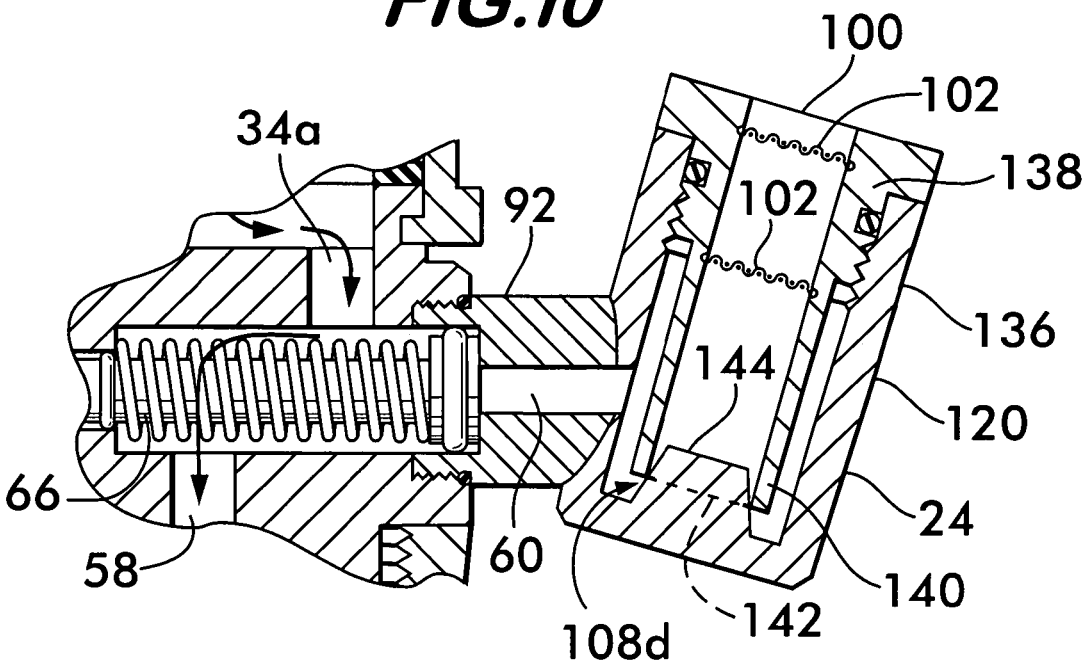
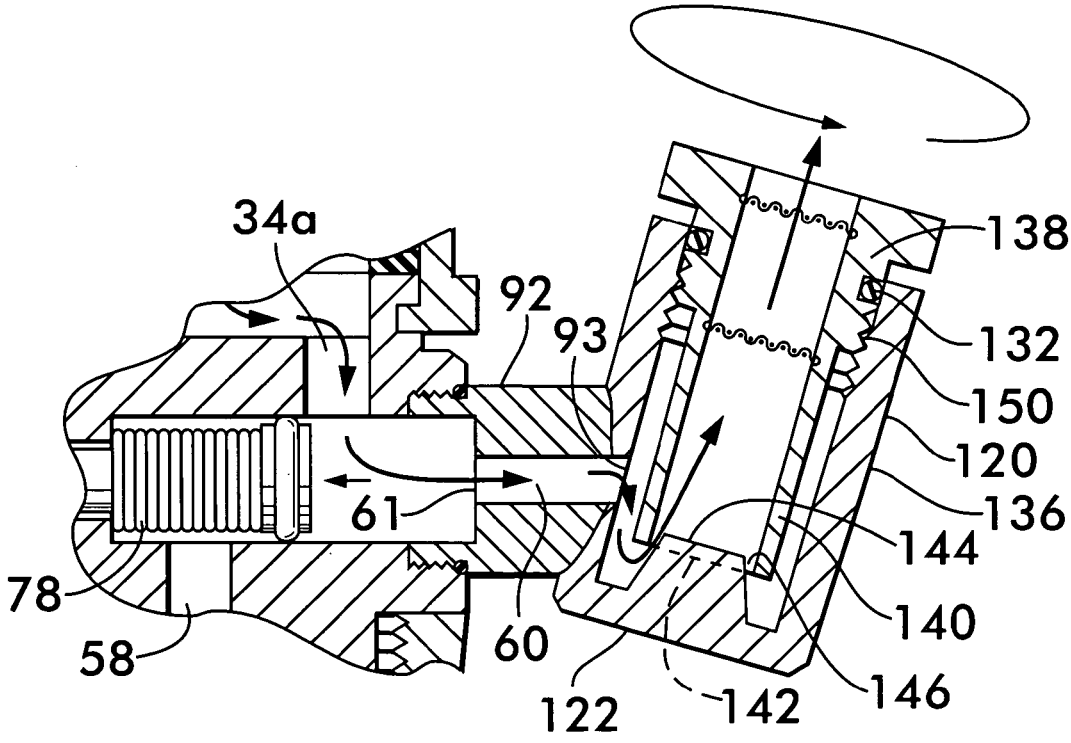
FIG.11

WATER FOUNTAIN ATTACHMENT FOR A FAUCET

BACKGROUND OF THE INVENTION

The present invention relates to water drinking fountains, and more particularly to an improved fountain attachment device for a water faucet.

Water faucets of the type commonly used in households provide a stream of water directed downwardly towards the sink. To get a drink of water, a container such as a cup or glass must be filled. In households with multiple people, this can require numerous glasses being used on a daily basis. Thus a water fountain like device could help eliminate the need for washing numerous glasses, and make getting a drink of water more convenient.

Various fountain attachment devices for water faucets have been proposed in the past which, when attached to a faucet, let the faucet serve two purposes—one discharging a stream of water downwardly towards the sink as a faucet typically does, and secondly discharging a stream of water in an upwardly direction for drinking directly from the stream as with a typical water fountain. Such previous devices have proved difficult or inconvenient to use, and provide little or no control over the height of the fountain stream.

Accordingly, it is an object of the present invention to provide a water fountain device that is easily attachable to a water faucet and which will permit a normal flow of water towards the sink as would the faucet, and which can be manually operated to direct a stream of water upwardly for direct drinking.

It is another object of the present invention to provide a water fountain device attachable to a water faucet that provides control over the water pressure for controlling the height of the fountain stream.

It is also an object of the present invention to provide a water fountain device attachable to a water faucet that is easily operable by the user.

These and other objects and advantages of this invention will be readily apparent from the following detailed description and accompanying drawings.

SUMMARY OF THE INVENTION

The present invention provides a water fountain diverter device that is connectable to the outlet of a faucet for selectively directing water from a downward direction towards a sink to an upward direction for direct drinking by a user. The device includes a diverter body connectable to the faucet to be supported therefrom, a diverter body inlet disposed for receiving water from the faucet, and a first outlet through which water can flow undiverted into the sink. A first fluid channel is provided within the diverter body for directing water to the first outlet. To provide a drinkable stream of water, a water fountain spout is supported on the device, which spout has a second outlet configured to provide the stream of water in an upward direction suitable for direct drinking by the user. A second fluid channel for directing water to the water fountain spout is also provided.

A device diverter valve having a valve chamber in fluid communication with the body inlet and the first and second fluid channels controls the flow of water. The valve has a valve member hand operable between a first position whereby the water flows undiverted to the first outlet, and a second position whereby the water flows to the water fountain spout. The valve member is biased towards the first position and has a face member against which the water pressure of the water flowing through the device acts to hold the valve member in the second position once said valve is manually moved to the second position, the valve returning to its first position when the water flowing through the device is stopped.

A restrictor can be provided to control the pressure of the water flowing to the spout, and thereby control the stream of water coming from the spout.

BRIEF DESCRIPTION OF THE DRAWINGS

The foregoing summary, as well as the following detailed description will be better understood when read in conjunction with the figures appended hereto. For the purpose of illustrating the invention, there is shown in the drawings several embodiments. It is understood, however, that this invention is not limited to the precise arrangement and instrumentalities shown.

FIG. 4 is a cross sectional view taken along line 4—4 as shown in FIG. 2;

FIG. 5 is a is a cross sectional view taken along line 5—5 as shown in FIG. 2;

FIG. 6 is a partial cross sectional view of an embodiment having a restrictor screw;

FIG. 7 is a partial cross sectional view of another embodiment having a sleeve restrictor;

FIG. 8 is a cross sectional view taken along line 8—8 as shown in FIG. 7;

FIG. 10 is a partial cross sectional view of another embodiment of a sleeve restrictor with a bottom opening; and FIG. 11 is a partial cross sectional view of the spout shown in FIG. 10 shown slightly opened to allow restricted flow through the spout.

DETAILED DESCRIPTION

Figure 1:
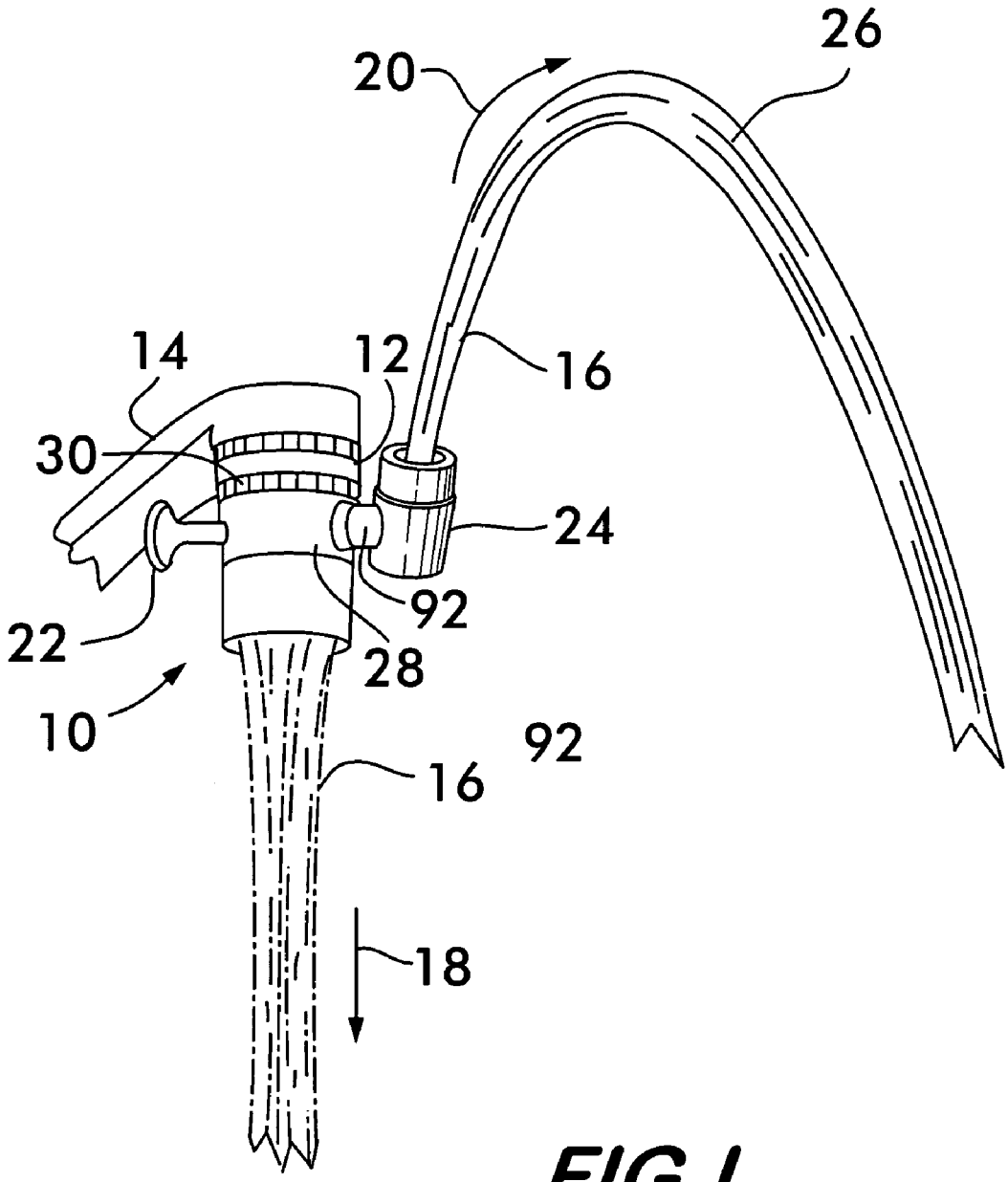
FIG. 1 is a perspective view of a device in accordance with the present invention shown connected to a faucet and showing both modes of operation—the water diverted for direct drinking by a user (solid line) and non-diverted flow into a sink (dotted line)

While particular embodiments of the invention are described herein, it is not intended to limit the invention to such disclosure and changes and modifications may be incorporated and embodied within the scope of the appended claims. In the drawings, which show several embodiments of the invention, like numerals indicate like elements throughout the several views. Water flow through the device of the present invention is indicated in some of the drawings with lines having arrows to indicate the direction of flow.

With reference to FIG. 1, the present invention provides a water fountain diverter device 10 which is connectable to the outlet 12 of a faucet 14, such as a lavatory sink faucet, for selectively directing water 16 from a downward direction 18 towards a sink to an upward direction 20 for direct drinking by a user as is typically done at a water fountain. As will be discussed in more detail below, the diverter device 10 allows all the water 16 to flow downward towards the sink for normal use of the faucet 14 as shown in dotted lines 16. Upon operation of the diverter device handle 22, the water 16 is diverted to a diverter device spout 24 which directs the water 16 upwards as shown in solid line whereby the user can place his or her mouth into the stream 26 for direct drinking. The pressure of the water can be controlled so that the stream of water 26 does not go too high and does not project beyond the sink perimeter during diversion for fountain like drinking.

Shown in FIGS. 2, 3, 4, and 5 is one preferred embodiment of the present invention. The water diverter device 10 has a cylindrical diverter body 28 having a cylindrical top swivel connector piece 30 having a circular opening 32 therein defining a diverter body inlet 34 for receiving the water 16 from the faucet 14, and has internal threads 36 for connection to male threads on the faucet 14 (an aerator may have to be removed on the typical faucet to expose the male threads). For faucet spouts that have a female thread, an adapter for going from a female to male thread may be used as is known in the art. A gasket 38, washer or O-ring for sealing against the faucet 14 is provided to provide a water tight connection. An optional restrictor 40, having an opening 42, and second gasket 44 (needed if adding the restrictor 40) can be added for controlling the pressure as further discussed below. The swivel connector 30 is rotatable relative to the lower section 46 of the diverter body 28 to allow the desired positioning of the device 10, which position is locked in place when the swivel piece 30 is tightened against the faucet outlet 12. Various gaskets, O-rings, and/or washers are described herein. These items can be used interchangeably in many instances as known in the art, and generally can be made of various resilient materials suitable for drinking water use.

The device 10 has an outlet 48 at a bottom end of the device 10 through which the water 16 can flow from the faucet 14 through the fountain device 10 undiverted, for example, towards the sink. The term "undiverted" as used herein means that the water is not diverted for fountain like use, but is directed to the sink as the faucet 14 would have done prior to the installation of the present device 10, although not necessarily the exact same direction. In the present embodiment, the outlet 48 includes an aerator 50 connected by a threaded connection 52 as shown. The aerator 50 is a standard aerator as known in the art having a screen 54 and gasket 56 for water tight connection.

Within the fountain device 10 is a first fluid channel 58 for directing the water 16 received from the inlet 34 to the outlet 48 through the diverter body 28. A second fluid channel 60, having an inlet 61, directs water received from the inlet 34 to the spout 24.

A diverter valve 62 is operable using the valve handle 22 for diverting water 16 which would otherwise be directed from the inlet 34 to the first fluid channel 58 and ultimately to the outlet 48, to the second fluid channel 60 and ultimately the spout 24. The valve 62 has a valve chamber 64 in fluid communication with the inlet 34 via the inlet channel 34*a* of inlet 34 for receiving the water therefrom, and with first fluid channel 58 and second fluid channel 60 for directing the water to the outlet 48 or spout 24 depending of the valve position as further described below.

Figure 2:
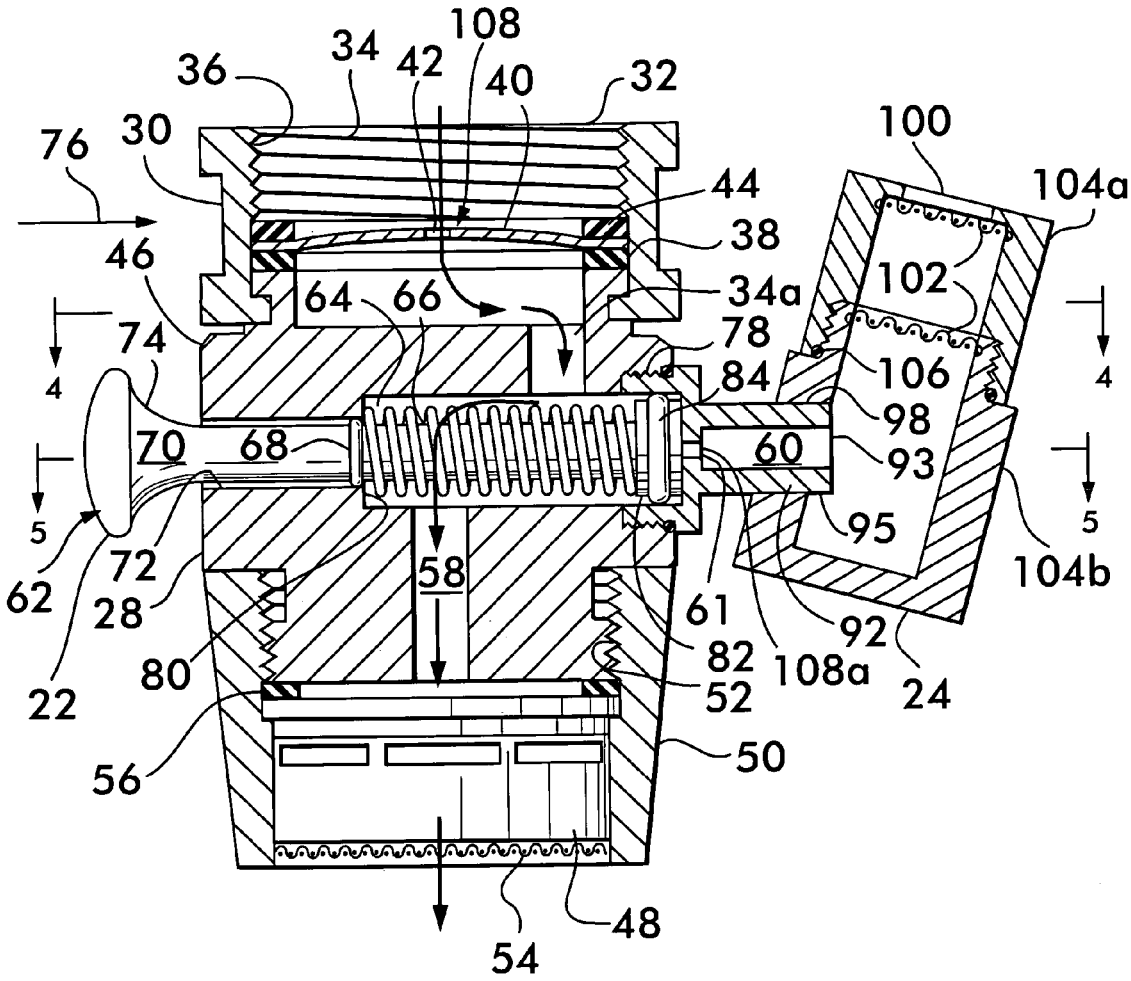
FIG. 2 is a cross sectional view of the device shown in FIG. 1 showing non-diverted water flow into the sink.
Figure 3:
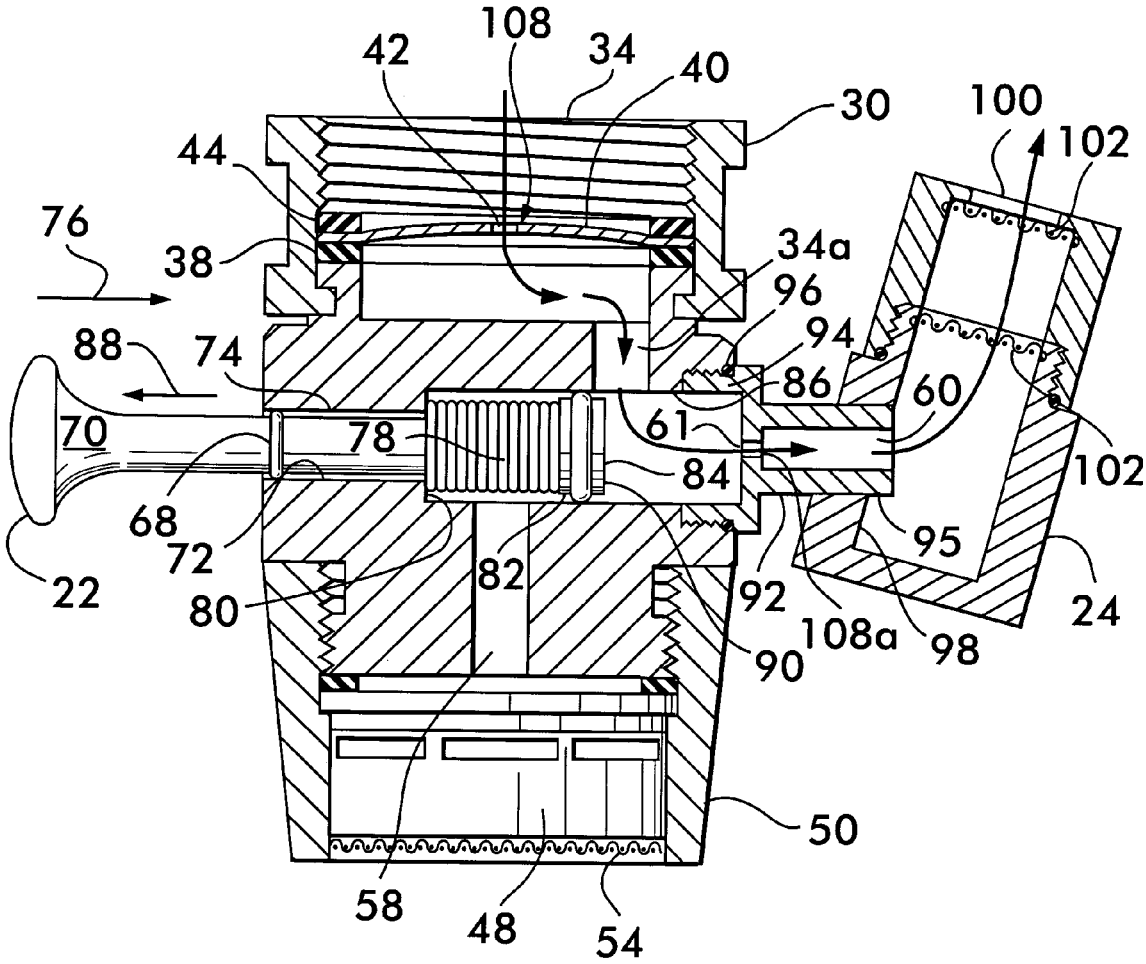
FIG. 3 is cross sectional view of the device shown in FIG. 1 showing diverted water flow through the spout for direct drinking by a user.

A valve member 66 attached to the handle 22 to be hand operable is slidably moveable within the valve chamber 64 between a first position as shown in FIG. 2 and a second position as shown in FIG. 3. In the first position as shown in FIG. 2, water 16 flows "undiverted" from the valve inlet 34 to the to the outlet 48 through the first fluid channel 58. In the second position as shown ion FIG. 3, the water 16 flows "diverted" from the valve inlet 34 to the spout 24 through the second fluid channel 60. An O-ring 68 attached to the valve member stem 70 creates a slidable seal against the cylindrical wall 72 of the valve member shaft opening 74, thus preventing water from leaking from the device 10.

The valve member 66 is biased towards the first position (direction 76) as shown in FIG. 2 by a spring 78 acting against a wall 80 of the valve chamber 64 and a distal end 82 of the valve member 66. An O-ring 84 (or other suitable seal material) is held in a circular recess in the distal end 82 of valve member 66 and is sized to form a moveable seal against the cylindrical wall 86 (FIG. 3) of the valve chamber 64 such that when the valve 62 is in the first position as shown on FIG. 2, water 16 passes through the valve chamber 64 to the first fluid channel 58 (suitable clearance through and around the valve member 66 and spring 78 is provided) and is prevented from passing to the second fluid channel 60. Therefore, it is seen that the O-ring 84 in combination with the distal end 82 seals against the cylindrical wall 86 of the valve chamber 64 to block the inlet 61 to the second fluid channel 60 and thus to the spout 24.

With further reference to FIG. 3, upon pulling the handle 22 in the direction 88 as shown, the distal end 82 with O-ring 84 seals off or blocks water flow to the first fluid channel 58 and directs the water 16 to the spout 24 through the second fluid channel 60. The end face area 90 of the distal end 82, with the O-ring 84, is acted on by the pressure of the water 16 to provide a suitable force thereon to maintain the valve 62 in the second position, overcoming the return force of the spring 78, as shown in FIG. 3.

Thus the use of the device 10 simply requires movement of the valve handle 22 to the second position, after which the user can let go. Once the water flow to the device 10 is stopped, e.g., shutting off the faucet 14 to which the device 10 is attached, the pressure holding the valve member 66 in the second position is dissipated, allowing the spring 78 to return the valve 62 to the first position as shown in FIG. 2.

Supported on the side of the diverter body 28 is the water fountain spout 24. The spout 24 is formed as an elongated cylindrical tube attached to and supported on a fluid conduit 92 having a cylindrical wall 95, and forming the second fluid conduit 60. The fluid conduit 92 has a threaded nipple section 94 having an O-ring 96 for water-tight attachment to the diverter body 28, this nipple section 94 being adjustable with a slight turn of the nipple along its threads to control the angle of the spout. The fluid conduit 92 also forms part of the valve chamber 64 as shown.

The spout 24 has an opening 98 through which the fluid conduit 92 is attached and through which water is received from the an outlet 93 of the fluid channel 60. The fluid conduit 92 may be attached to the spout 24 through any suitable means, e.g., threads, adhesives, friction fit, etc, this being a low water pressure connection and thus a gasket may not be needed. The spout 24 is inclined upwardly and outwardly from the body 28 terminating in a spout outlet 100. Water flowing through the spout 24 will therefore continue upwardly as shown in FIG. 1 to provide a suitable stream 26 of water for direct drinking by the user. The height and distance from the device 10 that the stream of water 26 travels will depend on the pressure of the water in the spout 24 as is further discussed below. Two screens 102 mounted within the spout 24 as shown are believed to provide a smooth and less turbulent stream of water 26. The spout 24 as shown in the present embodiment can be formed of an upper section 104*a* threaded to a lower section 104*b* with an O-ring 106 to make the connection water-tight.

The stream of water 26 preferably travels within the perimeter of the sink, and not so far as to splash water beyond this perimeter, such as onto a counter top or the floor. This projection of the stream of water 26 can be controlled by regulating the pressure of the water. As the water pressure from a faucet 14 may be higher than needed, some form of pressure reduction is preferable. This can be accomplished with restrictor 108 which restricts the flow of water so as to reduce the water pressure. A simple optional restrictor 108 is shown in FIGS. 2 and 3, here being formed as a circular restrictor plate 40 installed on top of the gasket 38 in the opening 32. The restrictor 40 has a small restriction opening or orifice 42 to restrict the flow of water there through, the size of the opening 42 being chosen to provide the necessary pressure drop for the desired stream 26 from the spout 24. This type of restrictor 108 has the advantage of being optional and easily added to the device 10 by the user at any time should there be a need for such as restrictor, although it is placed upstream of the valve 62 and thus lowers the pressure for the water flowing both downwardly un-diverted as well as upwardly when diverted. This type of restrictor can also be used in addition to other restrictors of the types further described below where additional restriction is desired.

Another type of restrictor 108*a*, this type built into the device 10, is now described with reference to FIGS. 2, 3 and 5. Here the restrictor 108 is formed as an orifice opening 110 in the wall of the valve chamber 64 at the inlet 61 to the second fluid channel 60, although it could also have been formed in any part of the second fluid channel 60. Again, the orifice opening 110 is sized to provide the desired pressure drop and water flow. As this restrictor 108*a* is downstream of the diverter valve 62 and placed in the flow going to the spout 24, only the water pressure to the spout is affected, the water pressure to the outlet 48 being unaffected.

Shown in FIG. 6 is a diverter device 10, identical to that of FIGS. 2 to 5, but having yet another embodiment of a restrictor 108 (the spout 24 is shown in a more simplified form, although it could take the same two piece form, 104*a* and 104*b*, as shown in FIG. 2). Here, a variable restrictor 108*b* has an elongated pressure control adjustment screw 112 of a diameter smaller than a diameter of the second fluid channel 60 such that water 16 can flow between the two, and preferably larger than the diameter of the inlet 61. The screw 112 has a proximal end 114 extending through the outer wall 116 of the spout 24, and a distal end 118 extending into the second fluid channel 60 towards the second fluid channel inlet 61. The proximal end of the 114 of the adjustment screw 112 is threaded into the wall 116 of the spout and has a slot 119 to be turnable by a screw driver or other suitable tool to move closer to or farther from the inlet 61. Moving the restrictor screw 112 towards the inlet 61 interferes with the flow through the inlet 61 to lower the pressure of the water passing into the spout 24 in a manner known in the art. Likewise, moving the screw away from the inlet 61 increases the pressure. The restrictor screw 112 can be used in conjunction with a restriction orifice 110 in the inlet 61 as shown in FIGS. 2 and 3, or without such an orifice in which the inlet 61 could be larger then shown, although preferably not larger than the diameter of the distal end 118 of the screw restrictor 112. As this restrictor 108*b* is downstream of the diverter valve 62 and placed in the flow going to the spout 24, only the water pressure to the spout is affected, the water pressure to the outlet 48 being unaffected.

Figure 9:
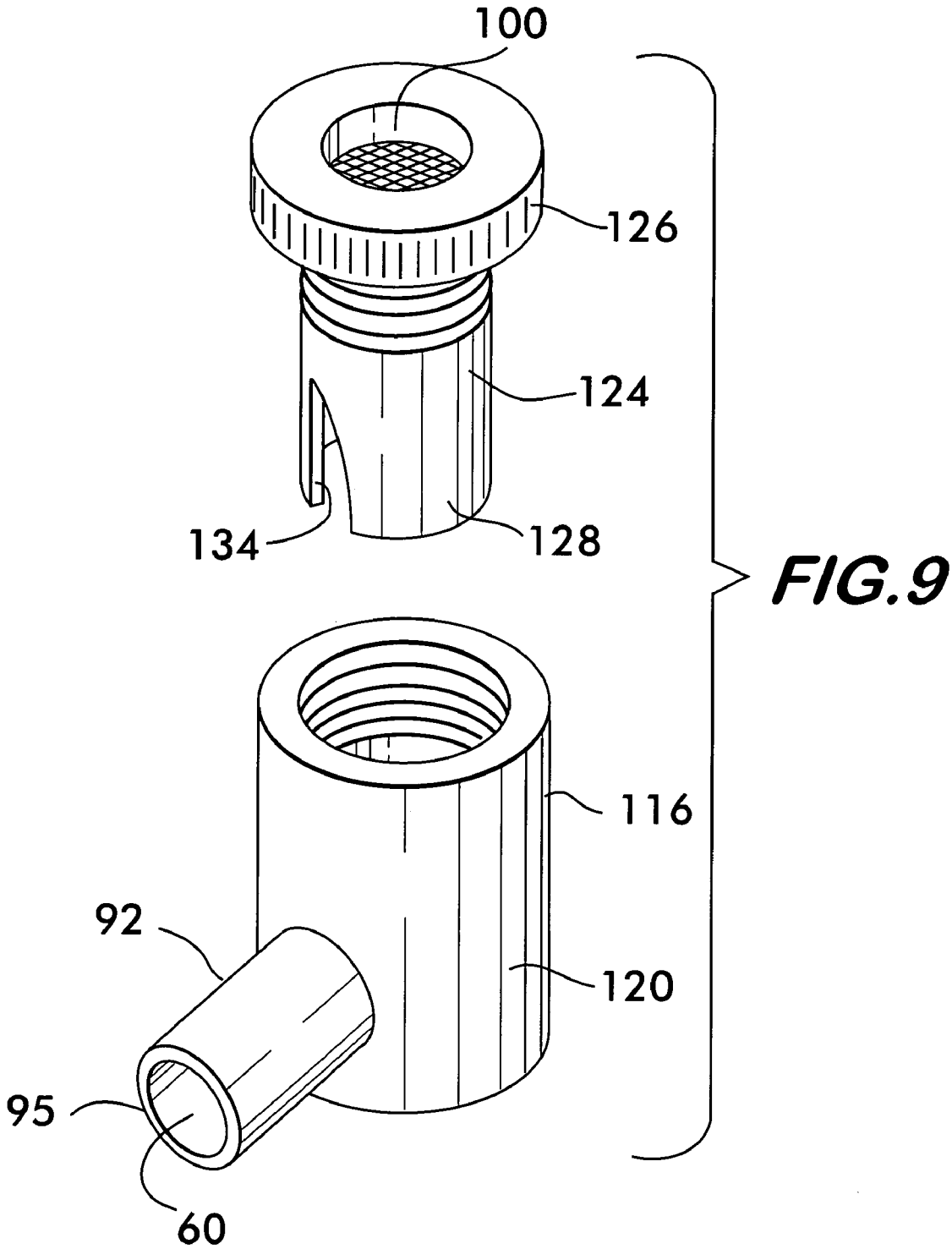
FIG. 9 is a perspective view of the spout of FIG. 7 showing the sleeve restrictor removed from the spout.

Shown in FIGS. 7, 8 and 9 is another embodiment of a spout 24 having yet another variable restrictor 108*c*. Here, the spout 24 has a cylindrical outer sleeve 120 forming the wall 116 and bottom 122, and also has a cylindrical inner sleeve 124 which forms the outlet 100 and which has a head piece 126, threads for threadably connecting to the outer sleeve 120 as shown, and has a cylindrical wall 128 with a close tolerance between it and the inside wall 130 of the outer sleeve 120. An O-ring 132 provides a water tight connection. The inner sleeve 124 contains an inverted "V" shaped opening 134 with one let curved as shown (FIG. 9) which cooperates with the outlet 93 of the second fluid channel 60 to control the flow of fluid there through. It is seen that the inner sleeve 124 can be rotated relative to the outer sleeve 120 to fully cover (block) the outlet 93 and thus prevent water flow through it, partially cover the outlet 93 with opening 134 to allow a restricted water flow, or align the full opening 134 with the outlet 93 to allow unrestricted water flow. Thus, the restrictor 108*c* is defined by the size of the outlet 93 left uncovered by the opening 134 in the inner sleeve 124. Like the restrictor 108*b* described above, this restrictor 108*c* is downstream of the diverter valve 62 and placed in the flow going to the spout 24, therefore only the water pressure to the spout is affected, the water pressure to the outlet 48 being unaffected.

Another embodiment of a variable restrictor 108*d* is now described with reference to FIGS. 10 and 11. Here, the spout 24 comprises an outer sleeve 136 and an inner sleeve 138 threadingly received within the outer sleeve 136 as shown. The inner sleeve 138 has a cylindrical wall 140 having an opening 142 (dotted line) along its bottom which cooperates with a seat member 144 formed in the bottom 122 of the outer sleeve 136 and which is shaped to close the opening 142 to prevent the flow of water there through when the inner sleeve 138 is in its bottom most position as shown in FIG. 10. A slight turn of the inner sleeve 138 to raise it relative to the outer sleeve 136 provides a small opening 146 for water flow as shown in FIG. 11. The size of the opening 142, and thus the amount of flow restriction, is controlled by the position of the inner sleeve 138 relative to the outer sleeve 136. It is seen that the outside diameter of the inner sleeve 138 below the threads 150 connecting it the outer sleeve 136 is sufficiently less than the inside diameter of the outer sleeve 136 to allow the water to flow between the sleeves on route to the opening 146. This restrictor 108*d*, the opening 146 formed by the open end 142 and the seat member 144, is downstream of the diverter valve 62 and positioned in the flow going to the spout 24, and thus only the water pressure to the spout is affected, the water pressure to the outlet 48 being unaffected.

The fountain diverter device 10 can be made of any suitable materials acceptable for drinking water. For example, the body 28 of the device and other typically metal parts such as the valve 62 can be made of chrome plated brass. The spring 78 and screens can be made of stainless steel, the O-rings can be made of neoprene, the washer made of a suitable resilient material such as rubber, and the restrictor 40 of brass.

Thus, the present invention provides a fountain diverter device 10 that is easily attachable to a water faucet. A water flow restrictor can be built into the device or provided as an add on. A drink of water does not require the use of a glass, but simply the operation of a handle to create a water stream suitable for direct drinking. To return the device for normal non-diverted use, the water to the faucet can be shut off, or the valve forced back to its original position.

What is claimed is:

1. A water fountain diverter device, connectable to the outlet of a faucet, for selectively directing water from a downward direction towards a sink to an upward direction for direct drinking by a user; said device comprising:

a diverter body connectable to the faucet to be supported therefrom;

a diverter body inlet disposed for receiving water from the faucet;

a first outlet through which water can flow undiverted into the sink;

a first fluid channel within said diverter body for directing water to said first outlet;

a water fountain spout supported on said device, said spout having a second outlet configured to provide a stream of water in an upward direction suitable for direct drinking by the user, said spout comprising an outer sleeve and an inner sleeve, wherein said inner sleeve has an opening which is moveable by moving said inner sleeve to restrict the flow of water to said second outlet;

a second fluid channel for directing water to said water fountain spout; and a diverter valve having a valve chamber in fluid communication with said body inlet and said first and second fluid channels, and having a valve member hand operable between a first position whereby the water flows undiverted to said first outlet, and a second position whereby the water flows to said water fountain spout, said valve member being biased towards said first position and having a face area against which the water pressure of said water flowing through said device acts on to hold said valve member in said second position once said valve is manually moved to said second position, said valve returning to said first position when said water to said device is stopped.

2. The water fountain diverter device of claim 1 wherein said valve member is configured to be moveable within said valve chamber so as to allow water to pass through said valve chamber from said inlet to said first fluid channel when said valve member is in said first position while at the same time blocking water flow to said second fluid channel, and to allow water to pass through said valve chamber from said inlet to said second fluid channel when said valve member is in said second position while at the same time blocking water flow to said first fluid channel.

3. The water fountain diverter of claim 1 further comprising a restrictor orifice opening positioned downstream of said valve to restrict the flow of water entering said spout.

4. The water fountain diverter device of claim 1 wherein the amount of movement of said outer sleeve is adjustable by controlling the position of said inner sleeve relative to said outer sleeve to thereby control the amount of restriction of said flow of water to said second outlet.

5. The water fountain diverter device of claim 1 wherein said sleeve opening is positioned on a side wall of said inner sleeve and cooperates with an outlet of said second fluid channel to control the flow of water to the spout.

6. The water fountain diverter device of claim 1 wherein said sleeve opening is positioned on a bottom of said inner sleeve, said spout further comprising a seat member configured to close said sleeve opening, the flow of water to the spout being controlled by moving said inner sleeve with respect to said seat member.

7. The water fountain diverter device of claim 1 wherein said water fountain spout comprises an inlet in fluid communication with said second fluid channel, and said spout is mounted on a side of said diverter body.

8. The water fountain diverter device of claim 1 wherein said second fluid channel comprises a fluid conduit external to the diverter body and the spout.

9. The water fountain diverter device of claim 1, wherein said inner sleeve opening is positioned in a side of said inner sleeve and said second fluid channel includes an outlet adjacent to said inner sleeve, said opening of said inner sleeve being rotatable relative to said second fluid channel outlet so as to control the size of said outlet through which water can flow, thereby controlling the amount of water that can flow from said spout.

10. The water fountain diverter device of claim 1, wherein said inner sleeve opening is positioned in a bottom of said inner sleeve, said inner sleeve opening cooperating with a seat member within said spout capable of closing said inner sleeve opening to control the amount of water that can flow into said opening.

11. The water fountain diverter device of claim 1, further comprising a flow restrictor disposed in said inlet.

12. A water fountain device in accordance with claim 9 wherein said second fluid channel outlet is formed in an inside wall of said spout outer sleeve.

13. A water fountain diverter device, connectable to the outlet of a faucet, for selectively directing water from a downward direction to an upward direction for direct drinking by a user; said device comprising:

a diverter body connectable to the faucet to be supported therefrom;

a diverter body inlet disposed for receiving water from the faucet;

a first outlet through which water can flow undiverted;

a first fluid channel within said diverter body for directing water to said first outlet;

a water fountain spout supported on said device, said spout having a second outlet configured to provide a stream of water in an upward direction suitable for direct drinking by the user;

a second fluid channel for directing water to said water fountain spout;

a diverter valve having a valve chamber in fluid communication with said body inlet and said first and second fluid channels, and having a valve member hand operable between a first position whereby the water flows undiverted to said first outlet, and a second position whereby the water flows to said water fountain spout, said valve member being biased towards said first position and having a face against which the water pressure of said water flowing through said device acts on to hold said valve member in said second position once said valve is manually moved to said second position;

an adjustable restrictor positioned in said spout for controlling the flow of water exiting from said second outlet; and a second restrictor for lowering the water pressure of the water received from the faucet, said second restrictor comprising an orifice opening positioned between said valve chamber and said spout.

14. The device of claim 1 wherein said diverter body comprises a swivel connector piece which permits the desired positioning of the device.

15. The device of claim 1 wherein said spout is mounted to be adjustably swivable relative to said diverter body.

16. The water fountain diverter device of claim 1 wherein said outer sleeve has a bottom and said inner sleeve opening is positioned on a bottom of said inner sleeve, wherein the flow of water from the spout can be controlled by increasing or decreasing a distance between the inner sleeve opening and said bottom of said outer sleeve.

17. A water fountain diverter device in accordance with claim 13 wherein said spout comprises and inner sleeve that is moveable to control the amount of restriction of said water flow from said second outlet.

18. A water fountain diverter device in accordance with claim 17 wherein said spout further comprises an outer sleeve, said inner sleeve being moveable relative to said outer sleeve to control the amount of restriction of said water flow.

19. A water fountain diverter device in accordance with claim 18 wherein said inner sleeve is rotatable and further comprises an opening which is moveable upon rotation of said inner sleeve to control the amount of restriction of said water flow.

20. A water fountain diverter device, connectable to the outlet of a faucet, for selectively directing water from a downward direction towards a sink to an upward direction for direct drinking by a user; said device comprising:

a diverter body connectable to the faucet to be supported therefrom;

a diverter body inlet disposed for receiving water from the faucet;

a first outlet through which water can flow undiverted into the sink;

a first fluid channel within said diverter body for directing water to said first outlet;

a water fountain spout supported on said device, said spout having a second outlet configured to provide a stream of water in an upward direction suitable for direct drinking by the user, said spout comprising an adjustable restrictor for restricting the flow of water to said second outlet, said restrictor comprising a spout outer sleeve and a spout inner sleeve, said inner sleeve having an opening which is moveable relative to said outer sleeve to control the amount of restriction of said flow of water;

a second fluid channel for directing water to said water fountain spout; and a diverter valve having a valve chamber in fluid communication with said body inlet and said first and second fluid channels, and having a valve member hand operable between a first position whereby the water flows undiverted to said first outlet, and a second position whereby the water flows to said water fountain spout.

21. The water fountain diverter device of claim 20 wherein said outer sleeve has a bottom and said inner sleeve opening is positioned on a bottom of said inner sleeve, wherein the flow of water from the spout can be controlled by increasing or decreasing a distance between the inner sleeve opening and said bottom of said outer sleeve.

22. The water fountain diverter device of claim 20 comprising a second restrictor for lowering the water pressure of the water flowing to said spout, said second restrictor comprising an orifice opening positioned between said valve chamber and said spout.

* * * * *